United States Patent [19]

Durocher

[11] 3,937,153

[45] Feb. 10, 1976

[54] SWINGING RAILWAY BOGIE BOLSTER

[75] Inventor: Jean Durocher, Crespin, France

[73] Assignee: A.N.F. - Frangeco, Crespin, France

[22] Filed: Apr. 24, 1974

[21] Appl. No.: 463,600

[30] Foreign Application Priority Data

Apr. 27, 1973 France ..... 73.15306

[52] U.S. Cl...... 105/190 R; 105/190 A; 105/193; 105/197 A

[51] Int. Cl.[2]..... B61F 3/08; B61F 5/06; B61F 5/08; B61F 5/12

[58] Field of Search..... 105/182 R, 190 R, 192, 105/197 A, 193, 199 R, 190 A

[56] References Cited

UNITED STATES PATENTS

| | | | |
|---|---|---|---|
| 35,410 | 5/1862 | Bridges | 105/190 R |
| 2,061,767 | 11/1936 | Hobson | 105/190 R |
| 2,841,096 | 7/1958 | Hirst | 105/197 A |
| 2,981,208 | 4/1961 | Sinclair | 105/197 A |
| 3,712,246 | 1/1973 | Lich | 105/197 A |

*Primary Examiner*—M. Henson Wood, Jr.
*Assistant Examiner*—Howard Beltran
*Attorney, Agent, or Firm*—Ralf H. Siegemund

[57] ABSTRACT

The bolster rocker-beam of a railroad vehicle bogie is coupled to the supporting cradle at each end by means of two elastic assemblies. Each assembly is applied at one end against a downwardly inclined transverse cradle face and at the other end against a transverse rocker-beam face which is substantially parallel to the cradle face when the assemblies are at rest.

7 Claims, 7 Drawing Figures

SWINGING RAILWAY BOGIE BOLSTER

This invention relates to secondary suspension systems for bogies of railroad vehicles of the type comprising a bolster rocker-beam which serves to support the vehicle body and each end of which rests in a swinging lateral cradle suspended at each end respectively at two points of the corresponding longitudinal frame member of the bogie which are located symmetrically with respect to the transverse vertical mid-plane of the bogie in order to permit pivotal motion of this latter about a longitudinal geometrical axis.

The aim of the invention is to provide a secondary suspension system of the aforementioned type which is of simple and economical structural design.

With this objective and in accordance with the invention, the coupling between each end of the bolster rocker-beam and the cradle which supports this latter is constituted by two elastic assemblies which are capable of working in compressive stress, in shear stress and in torsional stress, each of the two aforementioned assemblies being applied on the one hand against a transverse cradle face which is inclined downwards and towards the transverse vertical mid-plane of the bogie and on the other hand against a transverse face of the bolster rocker-beam which is substantially parallel to the aforementioned cradle face when the complete assembly is at rest.

In a structure of this type, the elastic assemblies serve to carry out both the transmission of vertical reactions produced by the weight of the vehicle body and the transmission of the torque which tends to restore the cradles towards their normal rest positions.

In one advantageous embodiment, each elastic assembly is made up of elastomer plates which are separated by metallic plates.

The invention finds a particularly advantageous application in the case of bogies of city railroad vehicles, especially when such vehicles are intended to run through tunnels and when the tracks have short-radius curves. In point of fact, the invention makes it possible to construct a swinging-suspension bogie of low height which is advantageous for running in tunnels and has a small lateral range of motion which limits the relative displacement of the vehicle body.

A better understanding of the invention will be gained from the following description and from the accompanying drawings in which one embodiment of a suspension system in accordance with the invention is shown by way of non-limitative example, and in which.

Figure 1:
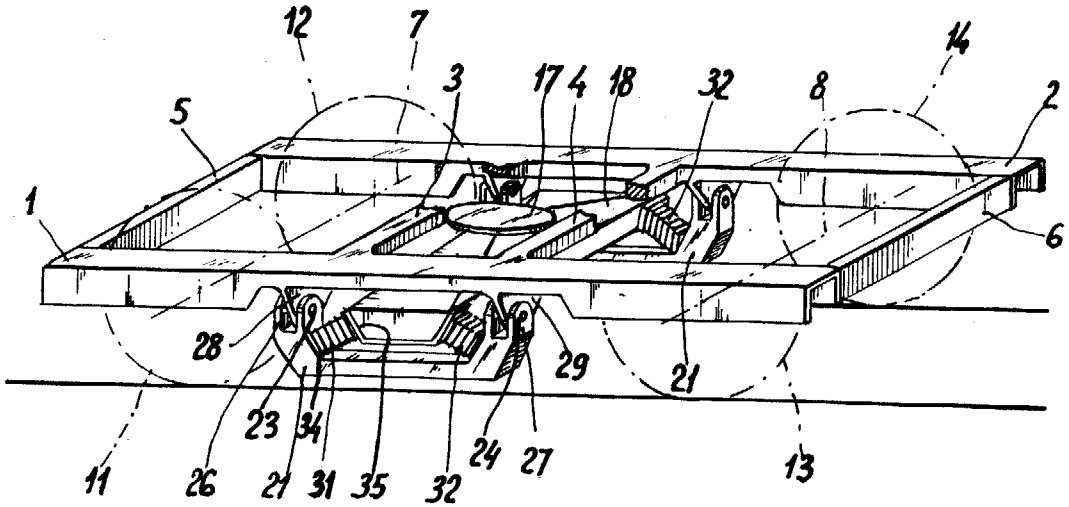
FIG. 1 is a schematic illustration in perspective showing the secondary bogie-suspension system in accordance with the invention.

The railroad vehicle bogie which is shown diagrammatically in perspective in FIG. 1 is essentially constituted by two longitudinal frame members 1, 2 which are joined together by means of two intermediate cross-members 3, 4 and two end cross-members 5, 6. The two axles 7, 8 which are indicated solely by their geometrical axes are rigidly fixed respectively to the wheels 11, 12 and 13, 14.

The vehicle body (not shown in the drawings) rests on a central circular bolster-plate 17 which is rigidly fixed to a rocker-beam 18. By means of an elastic system which will be described hereinafter, each end of said rocker-beam rests in a lateral cradle such as the cradle 21, the two ends of which are in turn suspended respectively by means of two pivot-pins 23, 24 fixed beneath the longitudinal frame member 1 along the same geometrical axis. It has been assumed in the example that the two end portions of the cradle 21 have the shape of yokes 26, 27 which embrace respectively two lugs 28, 29 which are integral with the longitudinal frame member, the pivot-pins 23 and 24 being passed through both arms of the yokes and through the corresponding lugs.

A coupling between each end of the bolster rocker-beam 18 and the cradle 21 which supports this latter is effected by means of two elastic assemblies designated respectively by the reference numerals 31 and 32 and each constituted in this example by an elastic block formed by a stack of elastomer plates separated by metallic plates. The lower end of each block aforementioned is applied against a transverse face such as the cradle face 34 which is inclined downwards and towards the transverse vertical mid-plane of the bogie whilst the upper end of said block is applied against a transverse face 35 of the bolster rocker-beam which is sustantially parallel to the face 34 when the entire assembly is at rest.

Each elastic assembly mentioned in the foregoing such as the assembly 31 or 32 is capable of working in compressive stress and in shear stress in order to transmit vertical loads as well as in torsional stress in order to return the cradles to their mean positions of stable equilibrium.

Figure 2:
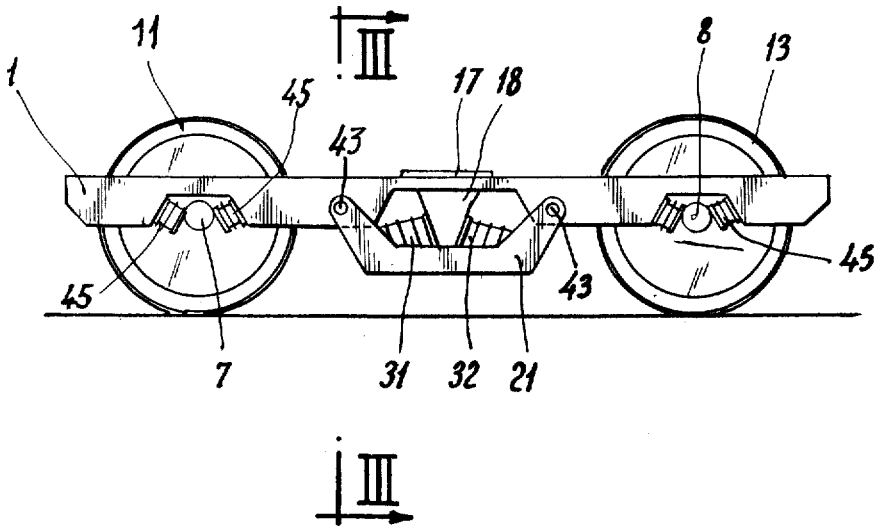
FIG. 2 is a view in profile showing a particular form of construction.
Figure 3:
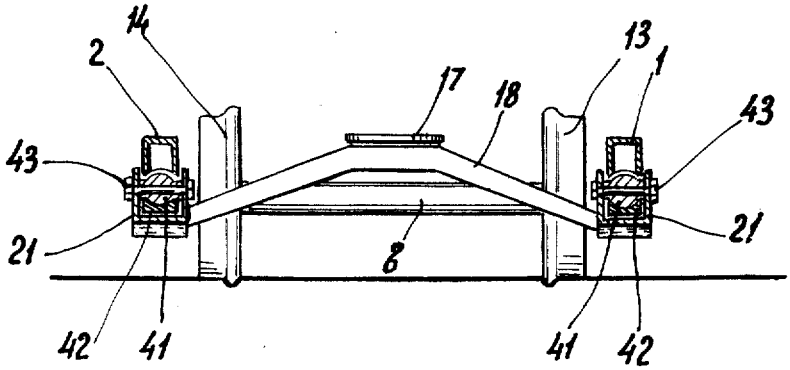
FIG. 3 is a transverse sectional view taken along line III—III of FIG. 2.

In FIGS. 2 and 3, there is shown one form of construction in which the same reference numerals have been retained in order to designate the same elements. The two longitudinal axes of pivotal motion of the ends of each cradle 21 are materialized by two spherical bearings such as those designated by the reference numeral 41 and housed within spherical bearing shells 42 which are rigidly fixed to the corresponding longitudinal frame member 1 or 2, the spherical bearing being attached to the cradle by means of a cross-bolt 43.

Each cradle 21 is therefore capable of pivoting on the longitudinal geometrical axis which passes through the centers of the spherical bearings 41 carried by one and the same longitudinal frame member in the same manner as in the embodiment shown diagrammatically in FIG. 1.

By way of indication, the primary elastic suspension elements 45 have also been shown diagrammatically in FIG. 2.

Figure 4:
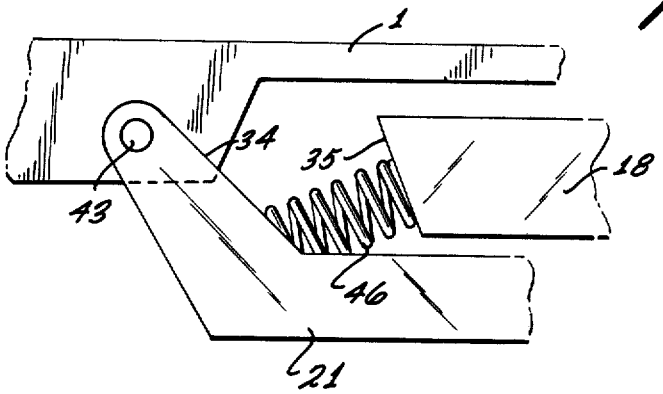
FIG. 4 is a profile view, similar to FIG. 2, showing the use of a helical spring in suspending the rocker beam of the bogie with respect to a supporting cradle.
Figure 5:
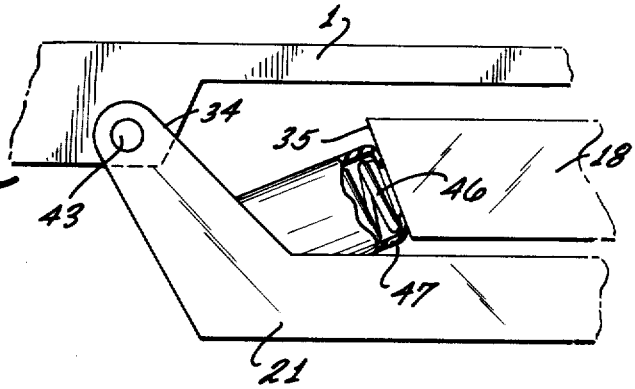
FIG. 5 is a profile view, similar to FIG. 4, in which the rocker beam is suspended with respect to a supporting cradle by a helical spring encased in an elastomer cover.

Turning to FIG. 4, which is a partial profile view, milar to FIG. 2, the rocker beam 18 is illustrated as eing supported with respect to the cradle 21 by a elical spring 46 which is interposed between the ocker beam face 35 and the face 34 of the cradle. As ill be noted, by comparing FIG. 4 with FIG. 1, the lastic assemblies 31 and 32 shown in FIG. 1 are simply eplaced with helical springs 46 in the embodiment of IG. 4. In the embodiment shown in FIG. 5, which is a rofile view similar to FIG. 4, the helical spring 46 is ncased in an elastomer cover 47.

Figure 6:
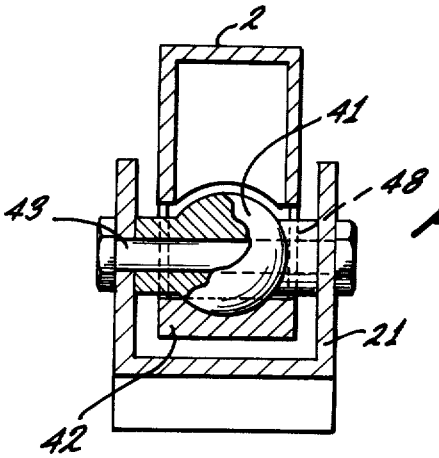
FIG. 6 is an enlarged sectional view of one of the spherical bearings as illustrated in FIG. 3 for suspension of the cradle with respect to the longitudinal frame of the bogie.

In FIG. 6, which is an enlarged sectional view of a pherical bearing 41, as generally shown in FIG. 3, the pherical bearing 41 is supported by a bearing shell 42 hich is rigidly fixed to longitudinal frame member 2 y any convenient means such as plates 48 which may e positioned on either side of the spherical bearing ith the plates disposed laterally with respect to the earing and the cross bolt 43 that secures the bearing o the cradle 21. As illustrated, the spherical bearing 41 nay, thus, undergo rotational movement with respect o the bearing shell 42 during transverse movement of he cradle 21 with respect to the longitudinal frame nember 2.

Figure 7:
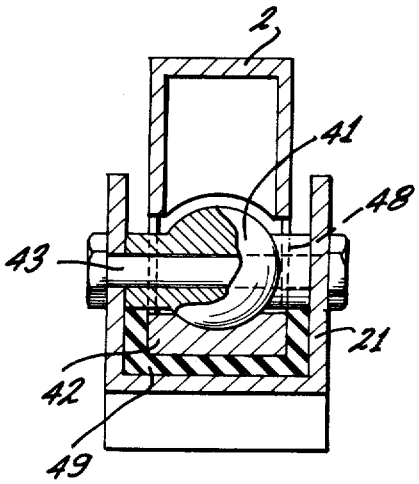
FIG. 7 is an enlarged sectional view, similar to FIG. 6 in which an elastomer is interposed between the cradle and the bearing shell to increase the transverse restoring force imparted to the cradle.

FIG. 7, which is a sectional view, similar to FIG. 6, llustrates use of an elastomer member 49 which is nterposed between the bearing shell 42 and cradle 21. Through use of elastomer member 49, during movenent of cradle 21 with respect to longitudinal frame nember 2 and the bearing shell 42 affixed thereto, the elastomer member is compressed to transmit a transverse restoring force to the cradle 21.

The invention is clearly not limited to the embodinent which has been described in the foregoing with reference to the accompanying drawings and which has been given by way of example; depending on the applications which are contemplated, modifications may accordingly be made without thereby departing either from the scope or the spirit of the invention.

From this it follows, for example, that the elastomer plates could be replaced by equivalent elastic systems such as, for example, helical compression springs either of bare metal or covered with elastomer.

Similarly and depending on requirements, the spherical bearings 41 can be:

— either of the friction surface type for the purpose of damping transverse oscillations, — or of the type in which provision is made for the interposition of elastomer for the purpose of increasing the transverse restoring force.

What is claimed is:

1. A railroad bogie comprising:

a bogie frame having a longitudinal axis and a transverse vertical mid plane;

wheels connected to said frame;

cradles pivotally suspended from said frame with each cradle having a long dimension that is positioned in a longitudinal direction with respect to said frame and each cradle having its long dimension positioned symmetrically with respect to said mid plane;

a bolster rocker beam supported within said cradles with the rocker beam in its rest position in substantial alignment with said mid plane;

said rocker beam having diverging side surfaces with each side surface making a uniform angle with said mid plane when the beam is in its rest position;

each of said cradles having a pair of diverging support surfaces with the support surfaces being substantially parallel to said side surfaces with the beam in its rest position;

spring means positioned between each support surface and each of said side surfaces;

each of said spring means having an end in contact with a support surface and another end in contact with a side surface;

each of said spring means having an axis which is inclined inwardly toward said mid plane from the support surface in contact with the spring means;

each cradle supporting a pair of spring means, and the axes of each pair of spring means supported by each cradle being in substantial longitudinal alignment, whereby each spring means undergoes cooperative movement with the other spring means in each pair of spring means in absorbing compressive stress, shear stress of torsional stress resulting from movement of the bolster beam away from its rest position.

2. The railroad bogie of claim 1 wherein said spring means is made up of elastomer plates separated by metallic plates.

3. The railroad bogie of claim 1 wherein said spring means includes a helical spring.

4. The railroad bogie of claim 3 wherein said helical spring is coated with an elastomer.

5. The railroad bogie of claim 1 including spherical bearings interconnecting said cradles and said frame.

6. The railroad bogie of claim 5 wherein said bearings include an elastomer to increase the transverse restoring force to said cradles.

7. The railroad bogie of claim 1 wherein said cradles have a generally U-shaped configuration.

* * * * *